US006016783A

United States Patent [19]

Begin

[11] Patent Number: 6,016,783

[45] Date of Patent: Jan. 25, 2000

[54] ENGINE CYLINDER HEAD HAVING INDUCTION HARDENED SURFACES RESISTANT TO FASTENER BOLT STRESSES

[75] Inventor: Roger E. Begin, Dearborn, Mich.

[73] Assignee: Detriot Diesel Corporation, Detroit, Mich.

[21] Appl. No.: 09/221,492

[22] Filed: Dec. 28, 1998

[51] Int. Cl.[7] ..... F01L 1/04

[52] U.S. Cl. ..... 123/193.5

[58] Field of Search ..... 123/193.5, 193.3; 29/888.06

[56] References Cited

U.S. PATENT DOCUMENTS 4,823,747 4/1989 Wagner et al. ..... 123/193.5

5,704,315 1/1998 Tsuchida et al. ..... 123/193.5

5,873,331 2/1999 Jutz ..... 123/193.5

OTHER PUBLICATIONS

Author: The ASM Committee on Induction Hardening Title: "Induction Hardening and Tempering".

*Primary Examiner*—Marguerite McMahon

*Attorney, Agent, or Firm*—Bill C. Panagos

[57] ABSTRACT

An engine cylinder head can be induction hardened in surface areas contacted by the heads of fastener bolts that are use to fasten the cylinder head to the cylinder block. The hardened surface areas, surrounding the bolt holes, are resistant to fatigue cracking that can otherwise result from thermal and mechanical stresses imposed by the fastener bolt head surfaces.

8 Claims, 1 Drawing Sheet

ENGINE CYLINDER HEAD HAVING INDUCTION HARDENED SURFACES RESISTANT TO FASTENER BOLT STRESSES

BACKGROUND OF THE INVENTION

1. Field of the Invention

The present invention relates to an internal combustion engine cylinder head, and particularly to a cylinder head having induction hardened surfaces surrounding the through holes that receive fastener bolts for fastening the head to the engine block.

Typically, an internal combustion engine will include an engine block and a cylinder head secured to said block by plural fastener bolts extending through the block into threaded openings in the block. Each fastener bolt has an enlarged head in facial engagement with an annular machined surface on the cylinder head, whereby the cylinder head is prevented from separating from the block.

During engine operation, the combustion process generates pressures that tend to cyclically increase the thermal and mechanical forces between the annular machined surfaces on the cylinder head and the bolt surfaces along the firedeck face. Also, high temperatures associated with the combustion process tend to thermally expand the cylinder head and block so as to increase the contact forces between the annular machined surfaces and the bolted joint.

In some cases, the high thermal/mechanical forces exerted the bolt hole surfaces on the head produce small cracks on the machined surfaces. The present invention relates to cylinder head construction designed to eliminate or substantially reduce the objectionable cracking on the head machined surfaces. The present invention greatly reduces the effects of thermally induced stress at the cylinder head outside diameter at the bolt holes sufficient to cause cracking.

The cylinder head of the present invention is manufactured by a process that includes the step of induction hardening the annular machined surface in contact with the integral seal that is used to secure the cylinder head to the engine block. The induction hardened surfaces are resistant to cracking or deformation under stresses imposed thereon thermally by cyclic stress.

It is believed that various engine surfaces have been induction hardened to achieve increased wear resistance and fatigue strength. However, fastener bolt-engagement surfaces on the cylinder head have apparently not been induction hardened for the purposes herein contemplated.

2. Description of the Related Art

Cachat, U.S. Pat. No. 4,438,310, discloses a method and apparatus for induction hardening the surfaces of cylinder valves on internal combustion engines. The apparatus comprises an induction coil having a flat frusto-conical surface adapted to be moved into close proximity to a conical valve seat surface. An alternating current is applied to the coil to generate a localized magnetic flux that inductively heats the valve seat.

Hayashi et al., U.S. Pat. No. 4,695,395, discloses heat treating selected surface areas on an aluminum alloy cylinder head. A laser energy source is passed across selected regions of the cylinder head to heat the affected regions to a molten condition. The motion speed of the laser is such that the molten areas rapidly resolidify to a densified condition after passage of the laser. The resolidificaiton process removes casting defects (e.g. pin holes and blow holes from the aluminum casting.

Wakasa, U.S. Pat. No. 4,530,323, discloses a cylinder head having fastener bolt holes formed in upstanding circular bosses integral with the head. Special reinforcing walls and ribs interconnect selected ones of the bosses to prevent the cylinder head from warping away from the block so as to degrade engine performance.

SUMMARY OF THE INVENTION

The present invention relates to a cylinder head wherein annular surfaces surrounding the bolt holes are induction hardened to an adequate depth, and more preferably to a uniform depth, from the inner edge of each annular surface to the outer edge. The induction heating apparatus comprises a flat-surfaced induction coil having an essentially annular configuration of approximately the same size as the surface that is to be hardened. The outer edge of the coil is closer to the work surface than the inner edge, so as to compensate for current density differences across the radial dimension of the coil surface. The coil is designed to produce an induction hardened surface of a sufficient depth, from the inner edge to the outer edge of the work surface.

Additional features of the invention will be apparent from the attached drawing and description of a cylinder head structure and surface hardening apparatus utilizing the invention.

BRIEF DESCRIPTION OF THE DRAWINGS

FIG. 1 shows an illustrative fastener bolt for fastening the cylinder head to an engine block.

DESCRIPTION OF A PREFERRED EMBODIMENT

Figure 1:
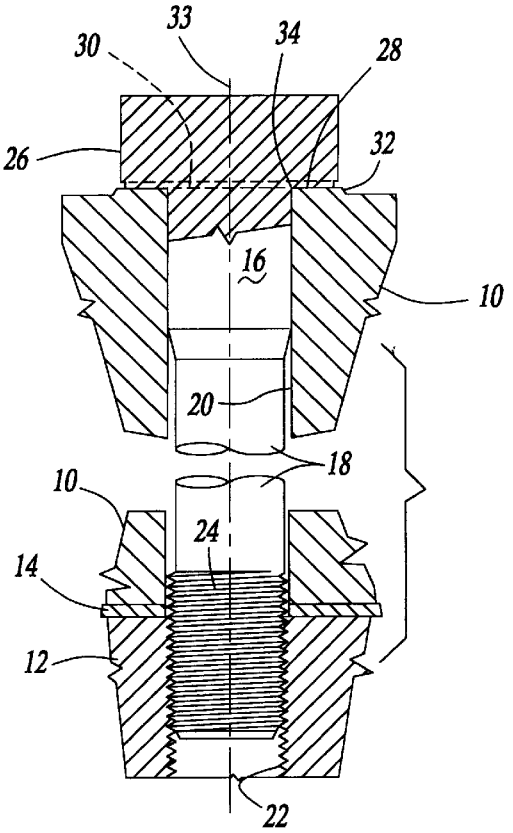
FIG. 1 is a fragmentary sectional view of a cylinder head embodying the invention.
Figure 2:
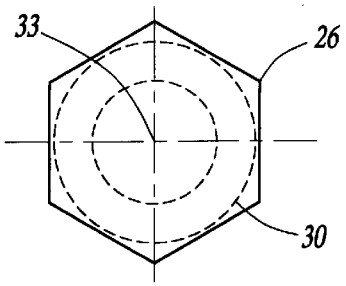
FIG. 2 is a top plan view of the fastener bolt shown in FIG. 1.

FIG. 1 fragmentarily shows a cast iron cylinder head 10 fastened to an engine block 12 by means of plural fastener bolts. A cylinder head gasket 14 is interposed between the lower face of the cylinder head and the upper face of the engine block.

The drawing shows a single fastener bolt 16 having a shank 18 extending downwardly through a bolt hole 20 in cylinder head 10 into a threaded opening 22 in the engine block 12. Threaded area 24 of shank 18 is in mesh with the threaded opening 22, whereby head 26 of the bolt exerts a clamp force on flat machined surface 28 of the cylinder head.

FIG. 1 shows a single fastener bolt 16. However, in practice several bolts are required to fasten the cylinder head to the engine block. Typically, there are two rows of fastener bolts located on opposite sides of the engine centerline. The bolts are spaced along the length dimension of the engine in the spaces between (or alongside) the cylinders. In some cases certain ones of the fastener bolts have threaded studs extending upwardly from the bolt heads to serve as fasteners for the cam shaft bearings. The present invention can be practiced with fastener bolts of various configurations. The number of fastener bolts is constant, regardless of the number of cylinders in the engine. A four cylinder engine may use seven fastener bolts for fastening the cylinder head to the engine block. Similarly, an eight cylinder engine will use seven bolts as well. The head of each fastener bolt will be in pressure contact with an annular flat machined surface similar to raised flat surface 28 (FIG. 1).

Machined surface 28 has a circular plan shape at least as large as that of a mating flat circular surface 30 on the underside of bolt head 26. As shown in FIG. 1, the outer circular edge 32 of machined surface 28 is located a slight distance further away from the bolt hole axis 33 than the outer edge of surface 30. The inner circular edge 34 of machined surface 28 is rounded as it merges with the cylindrical bolt hole 20. The rounded edge 34 relieves stress concentrations that could promote cracking in machine surface 28.

Figure 3:
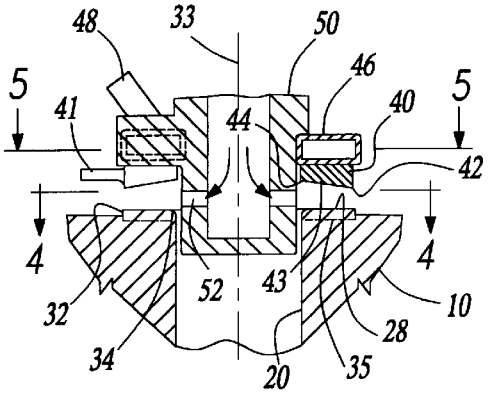
FIG. 3 is a fragmentary sectional view taken in the same direction as FIG. 1, but showing an apparatus for induction hardening on annular raised surface on the cylinder head adapted to be contacted by the head of the fastener bolt.
Figure 4:
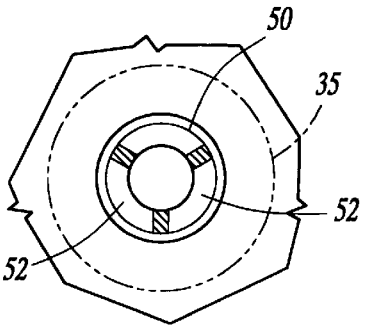
FIG. 4 is a transverse sectional view taken on line 4—4 in FIG. 3.
Figure 5:
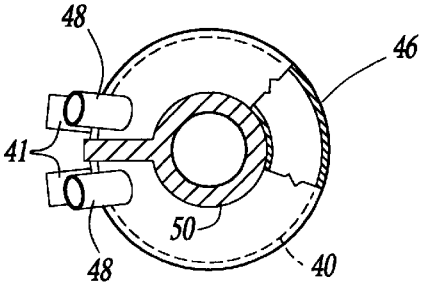
FIG. 5 is a transverse view of the FIG. 3 apparatus, with portions thereof taken on section line 5—5 in FIG. 3.

To further minimize stress cracking in machined surface 28, the machined surface is induction hardened to a depth of at least 0.04 inch. In FIG. 3 the hardened area is designated by numeral 35. FIGS. 3 through 5 illustrate an apparatus that can be used to indication harden annular circular surface 28.

The apparatus comprises an induction coil 40 having spade terminals 41 adapted for connection to an alternating current voltage source having a frequency in the range of 1 to 10 kilocycles. Coil 40 is a flat solid-conductive bar of pancake configuration, spaced a slight distance from work surface 28; the spacing is in the range of one eight inch to about one sixteenth inch in a direction parallel to central axis 33.

The generally flat undersurface 43 of coil 40 has a flat concave frusto-conical configuration, as depicted in FIG. 3. Outer rim 42 of the coil surface is somewhat closer to work surface 28 than inner rim 44 of the coil surface. This surface configuration compensates for the fact that the current density near inner rim 44 is greater than the current density near the outer rim 42. By having the outer rim 42 spaced a lesser distance away from surface 28 than inner rim 44, the effective magnetic flux is approximately the same along radial lines extending from central axis 33.

The coil configuration produces an essentially uniform depth hardness area 35 from inner edge 34 to outer edge 32 of surface 28. The induction hardened surface is thus well suited to resist high cyclic thermal stress imposed by the cyclic combustion process without producing the stress cracking that has been observed with non-hardened surfaces.

The induction hardening apparatus includes a cooling coil 46 in heat transfer contact with induction coil 40. Cooling coil 46 is provided with inlet and outlet tubes 48 that are connectable to a source of cooling fluid, typically water, whereby coil 46 is enabled to remove unwanted heat from induction coil 40 while coil 40 is electrically energized.

The induction hardening apparatus further comprises a tubular conduit 50 connectable to a source of cooling fluid for delivering the cooling fluid onto the annular machined surface 28 immediately after the surface has been induction heated by coil 40. Outlet openings 52 in the tube wall direct the cooling fluid onto surface 28. The cooling fluid is preferably compressed air, at room temperature. However, water or oil can be used, depending on the cooling requirement.

The flow of cooling fluid across surface 28 removes heat from the surface so as to exert a quenching effect on the cast iron crystallography, whereby the surface achieves a hardened condition.

Figure 6:
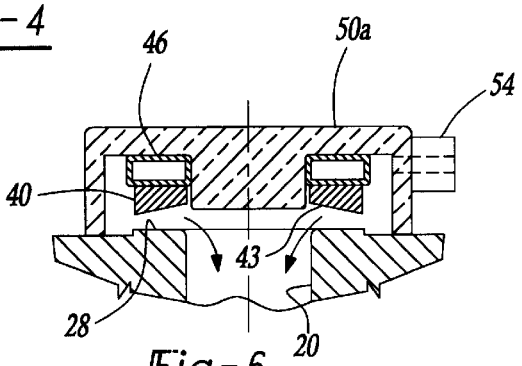
FIG. 6 is a view taken in the same direction as FIG. 3, but showing another apparatus that can be used in practice of the invention.

The direction of coolant flow along surface 28 can be varied while still practicing the invention. FIG. 6 shows an arrangement wherein the coolant flows radially inwardly toward the central bolt hole 20. The coolant is introduced to housing 50*a* through a tangential inlet tube 54. After swirling in a circumferential path within housing 50*a*, the coolant migrates into bolt hole 20; the swirling coolant removes heat from surface 28, thereby producing a quenching effect on the work surface material.

The invention has as its principal aim the achievement of an annular surface 28 that is induction hardened to a relatively uniform depth, from inner edge 34 to outer edge 32. The use of an induction heating coil 40 having a flat frusto-conical surface 43 achieves an essentially uniform heating of surface 28, necessary to produce the desired hardened surface. The hardness depth is a function of the current supplied to the induction coil.

What is claimed:

1. An engine cylinder head construction comprising:

a cylinder head casting having plural spaced, bolt holes adapted to receive bolts for fastening said cylinder head casting to an engine block; said casting having an annular raised machined surface surrounding each bolt hole; each annular machined surface having a circular outer edge and a circular inner edge; each circular inner edge having a rounded annular comer merging smoothly into an associated bolt hole surface; each annular raised machined surface being induction hardened to prevent the formation of cracks in said surface, due to stresses associated with engine operation.

2. The cylinder head construction of claim 1, wherein each annular surface is induction hardened to a uniform depth from the outer annular edge to the inner annular edge.

3. The cylinder head construction of claim 1, wherein said cylinder head casting is cast iron.

4. The cylinder head construction of claim 1, wherein each annular surface is induction hardened to a depth in excess of 0.04 inch.

5. The cylinder head construction of claim 1, wherein each annular surface is induction hardened by a process that includes the step of positioning a flat-surfaced induction coil in parallel spaced relation to the respective annular surface.

6. The cylinder head construction of claim 5, wherein the flat-surfaced induction coil has an outer circular rim and an inner circular rim, said outer rim being closer to the associated annular surface than said inner rim when the induction coil is operationally positioned in spaced parallel relation to the respective annular surface.

7. The cylinder head construction of claim 1, wherein the induction hardening process includes the step of flowing cooling fluid along the annular surface while the induction coil is operationally positioned in spaced parallel relation to said annular surface.

8. The cylinder head construction of claim 1, wherein each annular surface is induction hardened to a uniform depth from the outer annular edge to the inner annular edge; each annular surface being induction hardened by a process that includes the steps of positioning a flat-surfaced induction coil in parallel spaced relation to the respective annular surface, and applying an alternating current to said coil so that a toroidal magnetic field is generated around the coil and through said annular surface; said induction coil having an outer circular rim and an inner circular rim, said outer rim being closer to the associated annular surface than said inner rim when the induction coil is operationally positioned in spaced parallel relation to the respective annular surface.

* * * * *